US005694032A

United States Patent [19]

Gersbach et al.

[11] Patent Number: 5,694,032

[45] Date of Patent: Dec. 2, 1997

[54] BAND GAP CURRENT REFERENCE CIRCUIT

[75] Inventors: John E. Gersbach, Burlington; Charles J. Masenas, Jr., Essex Junction, both of Vt.

[73] Assignee: International Business Machines Corporation, Armonk, N.Y.

[21] Appl. No.: 619,447

[22] Filed: Mar. 19, 1996

[51] Int. Cl.[6] ..... G05F 3/26

[52] U.S. Cl. ..... 323/315; 323/308

[58] Field of Search ..... 323/314, 315, 323/316, 317; 307/352

[56] References Cited

U.S. PATENT DOCUMENTS 5,012,133 4/1991 Hughes ..... 307/352

5,180,966 1/1993 Sugawara et al. ..... 323/308

5,408,174 4/1995 Leonowich ..... 323/315

*Primary Examiner*—Peter S. Wong

*Assistant Examiner*—Rajnikant B. Patel

*Attorney, Agent, or Firm*—Eugene I. Shkurko

[57] ABSTRACT

A circuit for delivering an accurate reference current independent of operating frequency that is implementable on-chip and that is relatively insensitive to process and temperature variations. A frequency source controls a rate of charge transfer via a switched capacitor to generate a constant current over different frequencies. A complimentary doped FET provides a band gap voltage imposed over a known resistance to generate the output current.

16 Claims, 4 Drawing Sheets

Vdd
VP1
VP2
IØ
T0
T0b
T1
T1b
bg
I1
I2
I3
I4

BAND GAP CURRENT REFERENCE CIRCUIT

BACKGROUND OF THE INVENTION

1. Technical Field of the Invention

This invention pertains to integrated circuits. In particular, this invention is directed to an improved current reference circuit for use in IC chips, thereby providing a more accurate current reference regardless of input frequency.

2. Background Art

Prior art CMOS current references have required external voltage sources and external resistors to provide an accurate current. The best tolerance achieved in all prior integrated current references leaves room for improvement. The present invention provides a reference of better accuracy than any other prior art current reference circuit and can be completely contained on a standard CMOS chip.

It is an object of the invention to provide a more accurate on-chip current reference circuit.

It is another object of the invention to provide a reference current with reduced sensitivity to temperature and process variations.

It is yet another object of the present invention to provide a reference current circuit including multiple selectable switch capacitor circuits for generating a constant current at different frequencies.

SUMMARY OF THE INVENTION

An on-chip current reference circuit using a frequency source to control a rate of charge transfer via a switched capacitor. This invention also comprises a technique to transfer charge via a switched capacitor between two nodes that differ in voltage by the band gap of silicon ($V_{bg}$, approximately 1 V or more depending on the technology) at a rate controlled by an accurate frequency source. The output current is then proportional to $V_{bg} \times C_{SW} \times F_{refin}$ (wherein $C_{SW}$ is the switching capacitor capacitance and $F_{refin}$ is the frequency of the input). This technique makes good use of the two most accurate components available in state of the art CMOS processes.

Other features and advantages of this invention will become apparent from the following detailed description of the presently preferred embodiment of the invention, taken in conjunction with the accompanying drawings.

BEST MODE FOR CARRYING OUT THE INVENTION

Pumper Circuit

Figures 1, 1A, 1B:
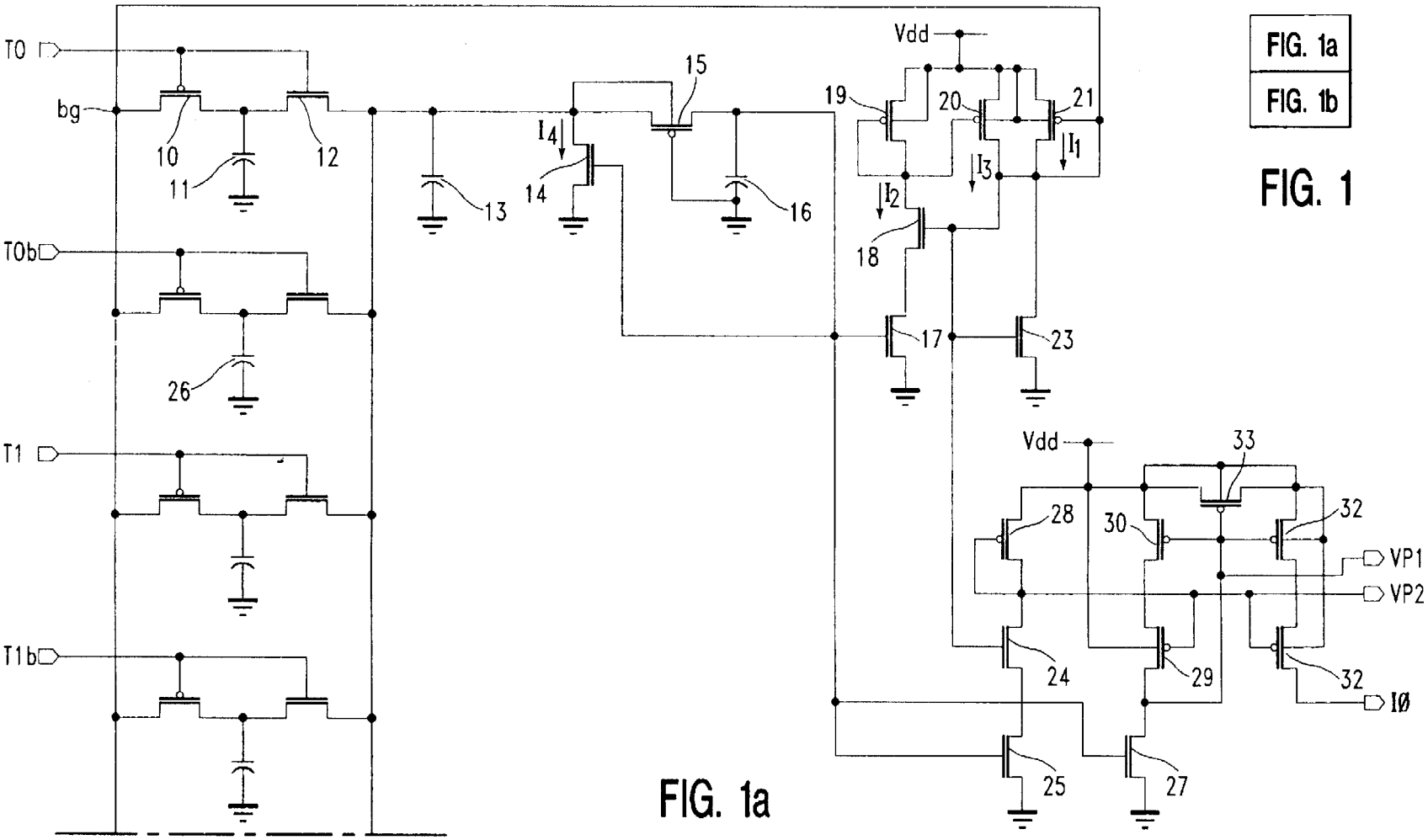
FIG. 1*a–b* illustrates the current reference circuit of the present invention.
Figure 2:
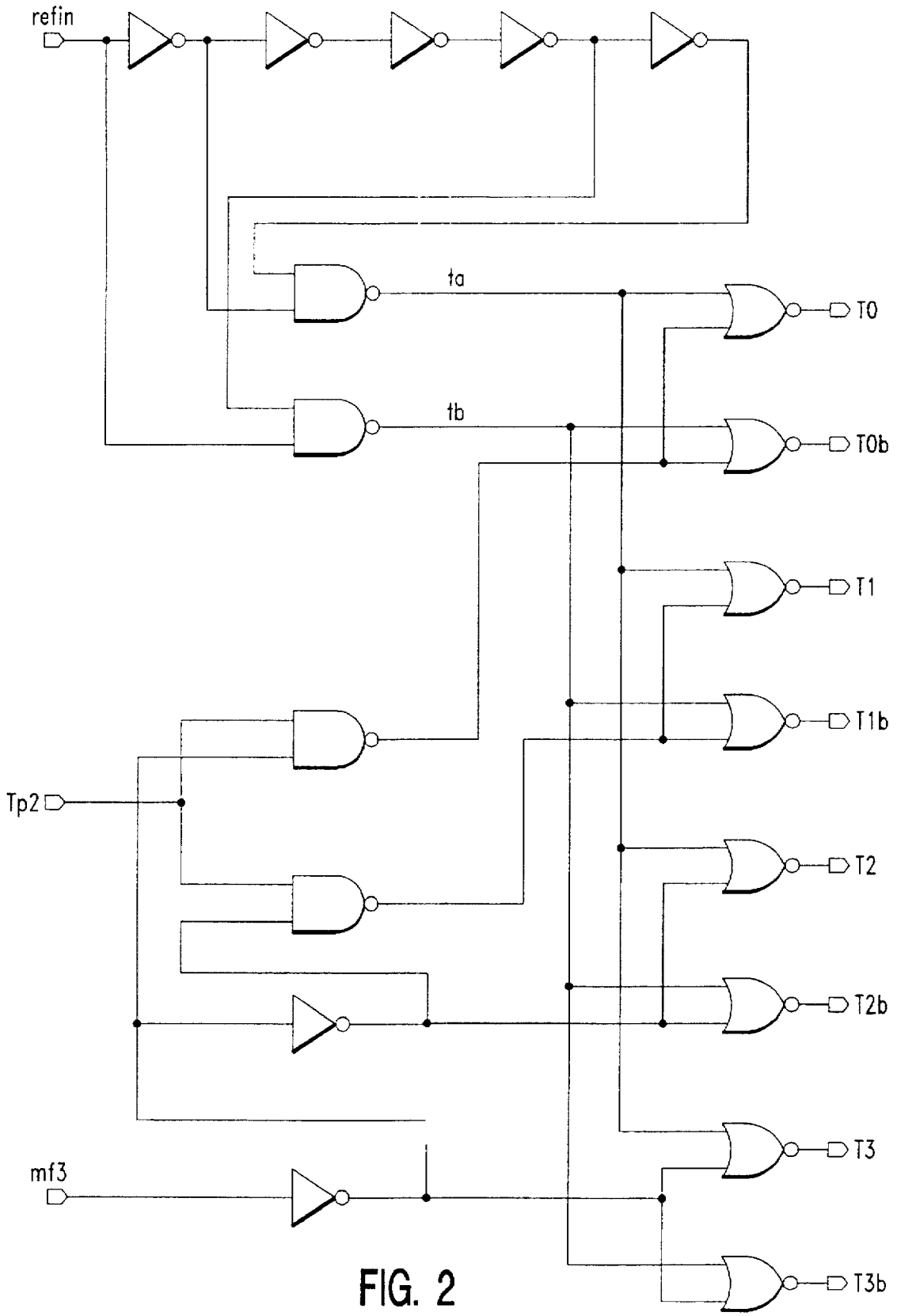
FIG. 2 illustrates the programmable pulse generator for selecting switching capacitors to maintain the reference current over various operating frequencies.

With reference to FIG. 1, T0 through T3*b* are inputs from the pulse generator (FIG. 2 ). For simplicity the following discussion will focus on inputs T0 and T0*b*, however, it is noted that the other input pairs, connected in parallel with T0, operate in a manner equivalent to the following discussion. Special transistor 23 is an NFET with a P-doped gate, which displays normal NFET characteristics except that its threshold voltage is increased above the normal value by an amount equal to the band gap of silicon ($V_{bg}$). It is driven by a PFET current mirror comprising transistors 19 and 20 (sometimes referred to as "legs"of the current mirror) which, in turn, is driven by an NFET current mirror comprising transistor 14 and transistor 17. Transistor 14 is a diode connected NFET with an equivalent RC integrator formed by transistor 15 and capacitor 16. The integrator, using the high channel resistance of transistor 15 and a large capacitor 16 for a long time constant, significantly reduces the drain ripple (discussed below) in transistor 14 via its gate. Capacitor 13 is the main filter capacitor, capacitor 11 is the switching capacitor and transistors 10 & 12 are the switches. Transistor 21 is a PFET diode with a very long, very narrow channel that is used when power is applied to the circuit. As the circuit is powered on, the rising voltage at node bg reduces the starting current $I_1$ to zero for all cases except when the power supply is operated at voltages of approximately 2.7 volts or greater. Transistors 18 and 24 are cascode transistors to keep the drain voltages steady on transistors 17 and 25, respectively. The circuit is operable for processes with about 2.5 volt power supply but may be operated at greater than about 3.3 volts in some applications.

Assuming the circuit has been powered on and input T0 is switching at an appropriate rate, capacitor 11 is alternately charged to $V_{bg}+V_t+V_{od}$ (silicon band gap, threshold, and overdrive voltages ) of transistor 23 and discharged to $V_t+V_{od}$ of transistor 14. If the switching rate is high with respect to the time constant formed by capacitor 13 and transistor 14, and the capacitance of capacitor 13 (Cf) is large with respect to capacitor 11, the switches 10 and 12 together with capacitor 11 can be thought of as a resistance, or impedance, ($R_{eq}$) equivalent to $1/(C_{SW} \times F_{refin})$ that is connected between nodes bg and capacitor 13.

Notice that the two current mirrors (transistors 19 & 20, transistors 14 & 17) and $R_{eq}$ form a positive feedback loop which has high gain until the currents ($I_2$, $I_3$) turn on and then the gain is drastically reduced owing to diode connected transistor 23 and the ratio of $R_{eq}$ to the channel resistance of transistor 14. The gain of the NFET mirror is approximately unity and the gain of the PFET mirror about 4. This ensures that capacitor 11 will be quickly charged to the voltage at node bg when transistor 10 is switched on. Capacitor 13 ensures that the voltage change across transistor 14 will be small as transistor 12 discharges capacitor 11 into capacitor 13. The average current passing through $R_{eq}$ is then the same as the average current in transistor 14.

The sizes of transistor 23 and transistor 14 are chosen so that their respective overdrive voltages are about the same. Since their threshold voltages are also about the same except for the effect of complimentary gate doping on transistor 23, the voltage difference appearing across $R_{eq}$ is very nearly equal to $V_{bg}$.

Figure 1C:
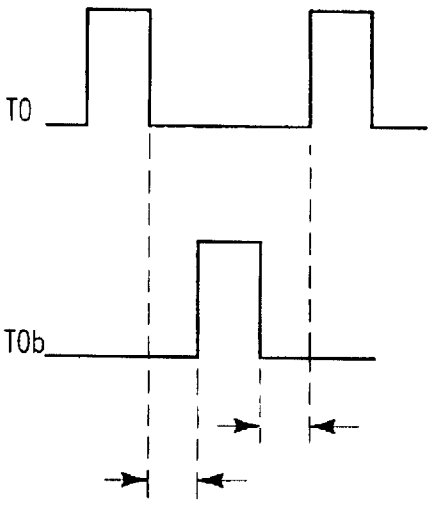
FIG. 1*c* illustrates the complementary refin frequencies (not to scale).
Figure 1B:
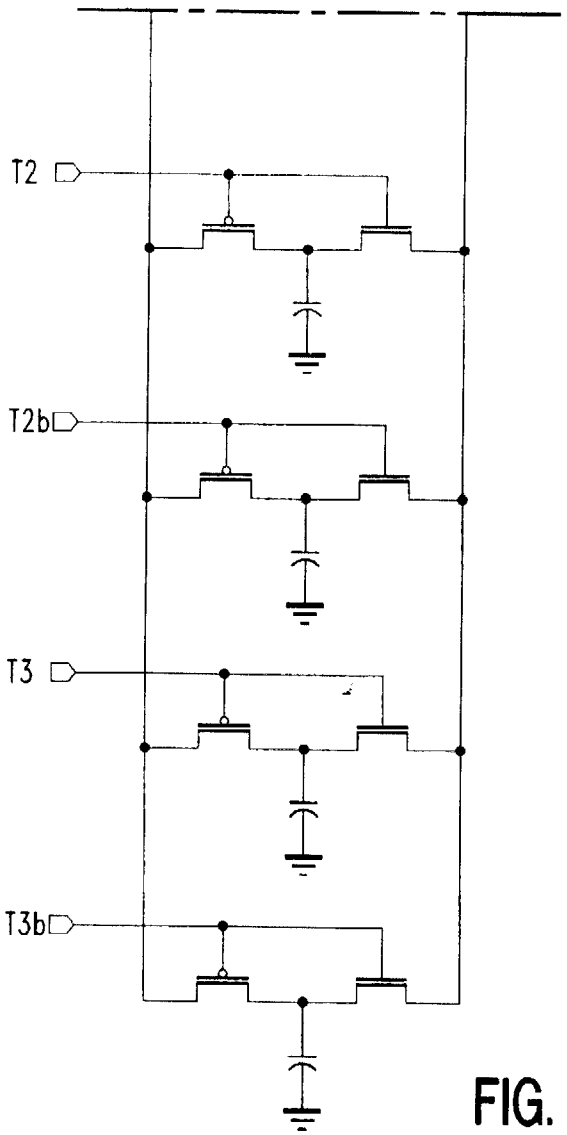

Considering T0*b*, which is the compliment of T0 except there is a short time between pulses when both are down (see FIG. 1C, not to scale), it is connected to a second set of switches and capacitor. When capacitor 11 is being discharged into capacitor 13 and transistor 14 (through transistor 12) capacitor 26 is being charged to the voltage at node bg. Similarly, when capacitor 11 is being charged to the voltage at node bg, capacitor 26 is being discharged into capacitor 13. This results in a doubling of the average current in transistor 14, a doubling of the ripple frequency, and a halving of the ripple voltage across capacitor 13.

For processors operable at various application frequencies, it is desirable to keep the reference current constant for all operating frequencies. This means that the product of the total capacitance and operating frequency must be kept constant. For those cases where it is desired to deactivate switching capacitors, its switching input (i.e. any of inputs T0 through T3*b*) is held at a DC level. The level may be either up or down but in the present case it is held up which places the switching capacitor in parallel with capacitor 13, which has no influence on the average current into transistor 14.

Useful outputs VP1 and VP2 are generated by further mirroring the reference current in transistor 14 ($I_4$) into transistors 25 and 27. Transistor 25 drives transistor 28 through a cascode transistor 24 to provide reference voltage VP2 for cascode transistor 29 and other loads. Transistor 27 drives the reference transistor 30. Output currents I0 are then provided in transistor 31 and its cascode transistor 32 and as many similar pairs connected in parallel as may be desired. The VP1 output voltage determines the amount of current obtained from I0. Transistor 33 is connected as a MOS capacitor which further decouples switching noise and noise appearing on $V_{dd}$.

Logical Pulse Generator

Referring to FIG. 2, the pulse generator is shown with programmable inputs Tp2 and mf3 for selecting which output pairs are to be switched at the input reference ($F_{refin}$) as follows:

| $F_{refin}$ | Tp2 | mf3 | Selected |
|---|---|---|---|
| 25 MHz | 1 | 0 | T0 T2 |
| 33 MHz | 1 | 1 | T1 T3 |
| 50 MHz | 0 | 0 | T2 |
| 66 MHz | 0 | 1 | T3 |

The circuitry at the top of FIG. 2 generates lines ta and tb, which are the true and complement of refin with some space between them (see FIG. 1C, not to scale) so that output pairs are non-overlapping. This ensures that the charge on any active switching capacitor is cleanly transferred to capacitor 13 and not to another active switching capacitor. The output current is proportional to $V_{bg} \times C_{SW} \times F_{refin}$, thus, the complementary switching capacitors may be selected depending on the applied operating frequency, which is not limited by the example table shown above. Any number of switching capacitor circuits may be coupled in parallel to handle any number of operating frequencies.

Alternative Embodiment

Figure 3:
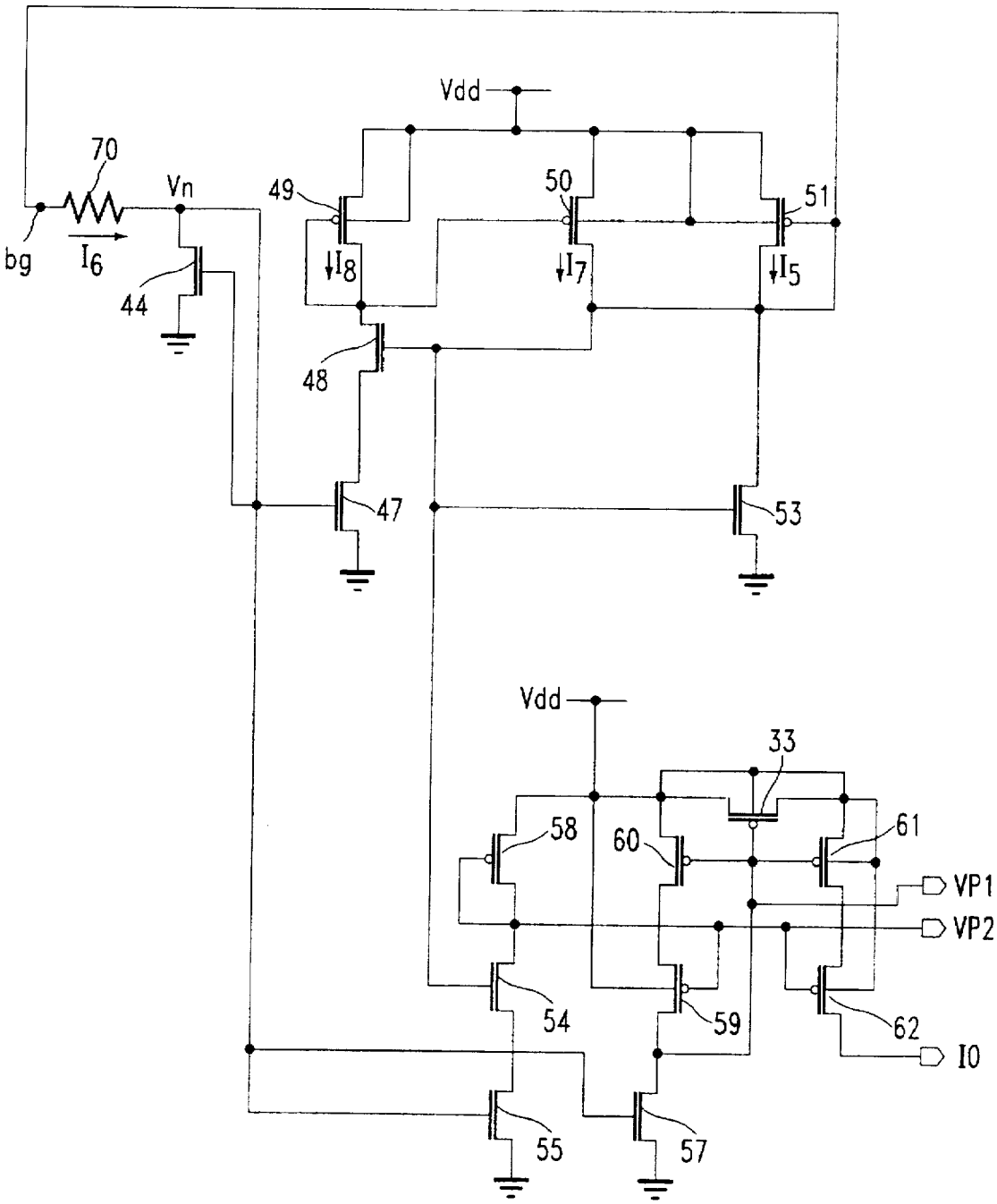
FIG. 3 illustrates an alternative embodiment of the current reference circuit.

Referring to FIG. 3, whose similarities to the circuit of FIG. 1 are readily apparent, an alternative embodiment is illustrated comprising a technique to connect a precision resistor between two nodes (bg and Vn) that differ in voltage by $V_{bg}$. The output current I0 is then proportional to $V_{bg}/R$, wherein R is the resistance of resistor 70. Transistor 53 is an NFET with a P-doped gate, which displays normal NFET characteristics except that its threshold voltage is increased above the normal value by an amount equal to the band gap of silicon ($V_{bg}$). It is driven by a PFET current mirror comprising transistors 49 and 50 which, in turn, is driven by an NFET current mirror comprising transistor 44 and transistor 47. Transistor 44 is a diode connected NFET. Transistor 51 is a PFET diode with a very long, very narrow channel that is used when power is applied to the circuit. As the circuit is powered on, the rising voltage at node bg reduces the starting current $I_5$ to zero for all cases except when the power supply is operated at voltages of approximately 2.7 volts or greater. Transistors 48 and 54 are cascode transistors to keep the drain voltages steady on transistors 47 and 55, respectively. The circuit is operable for processes with about 2.5 volt power supply but may be operated at greater than about 3.3 volts in some applications.

Assuming the circuit has been powered on, resistor 70 is connected between nodes bg and Vn whose voltages are $V_{bg}+V_t+V_{od}$ of transistor 53 and $V_t+V_{od}$ of transistor 44, respectively, thereby creating the current $I_6$, $V_{bg}/R$.

Notice that the two current mirrors (transistors 49 & 50, transistors 44 & 47) and resistor 70 form a positive feedback loop which has high gain until the currents turn on ($I_6$, $I_7$) and then the gain is drastically reduced owing to diode connected transistor 53 and the ratio of resistor 70 to the channel resistance of transistor 44. The gain of the NFET mirror is approximately unity and the gain of the PFET mirror about 4. This ensures that transistor 53 will have small current variations. The current in resistor 70 ($I_6$) flows through transistor 44.

The sizes of transistor 53 and transistor 44 are chosen so that their respective overdrive voltages are about the same. Since their threshold voltages are also about the same except for the effect of complimentary gate doping on transistor 53, the voltage difference appearing across resistor 70 is very nearly equal to $V_{bg}$.

Useful outputs VP1 and VP2 are generated by further mirroring the reference current in transistor 44 ($I_6$) into transistors 55 and 57. Transistor 55 drives transistor 58 through a cascode transistor 54 to provide reference voltage VP2 for cascode transistor 59 and other loads. Transistor 57 drives the reference transistor 60. Output currents are then provided in transistor 61 and its cascode transistor 62 and as many similar pairs connected in parallel as may be desired. The VP1 output voltage determines the amount of current obtained from I0. Transistor 63 is connected as a MOS capacitor which decouples noise appearing on $V_{dd}$.

Manipulating FET Thresholds

The circuit embodiments described above advantageously exploit the increased threshold voltage of a complementary doped FET. It is well known in the art to selectively dope FETs via ion implantation, for example, to vary the threshold voltage. Such channel tailoring can be used to produce FETs with a lower than normal threshold voltage by, for example, an increased ion implantation of a selected impurity. Thus, the inventive circuits shown in FIGS. 1 and 3 can also be implemented by using a conventional FET for transistors 23 and 53, respectively, and replacing transistors 14 and 44 with FETs having below normal thresholds. Thereby, the difference in threshold voltage appears across $R_{eq}$ (FIG. 1) or resistor 70 (FIG. 3 ) to provide the reference current. Transistors 17, 25, and 27 (FIG. 1) and transistors 47, 55, and 57 (FIG. 3) would also be replaced with FETs having below normal thresholds for proper circuit performance.

Advantages over the Prior Art

The advantages of the method of the preferred embodiment of this invention include a more accurate current reference with reduced dependency on temperature and process variation. A number of complementary capacitor switching circuits is provided to be selected based on the operating frequency.

Since changes may be made in the above structure and process without departing from the scope of the invention described herein, it is intended that all the matter contained in the above description or shown in the accompanying drawings shall be interpreted in an illustrative and not in a limiting sense. For example, the polarity of the components may be replaced by equivalent components of opposite polarity, i.e. PFETs for NFETS. Thus, other alternatives and modifications will now become apparent to those skilled in the art without departing from the spirit and scope of the invention as set forth in the following claims. Accordingly, the scope of protection of this invention is limited only by the following claims and their equivalents.

What is claimed is:

1. A current reference circuit comprising:

an NFET having its gate doped with impurities for increasing a voltage threshold of the NFET by about a band gap of silicon;

a PFET current mirror having a first one of its legs coupled to the NFET for providing a current flowing through the NFET;

an NFET current mirror coupled to a second leg of the PFET current mirror for controlling an amount of current provided by the PFET current mirror;

switching capacitor means coupled to the NFET and to the NFET current mirror such that an amount of increase of the NFET's threshold voltage generated by the impurity doping is applied across the switching capacitor means; and the switching capacitor means including a switching capacitor, means for receiving an input frequency, and means for charging and discharging the switching capacitor in response to the input frequency received at the switching capacitor means, which charging and discharging of the switching capacitor produces a reference current flowing from the switching capacitor means into the NFET current mirror, said reference current for said controlling the amount of current provided by the PFET current mirror.

2. The current reference circuit of claim 1 wherein a current flowing through said second leg of the PFET mirror controls a current flowing through said first leg of the PFET mirror, said current flowing through the first leg of the PFET mirror for providing said current flowing through the NFET and for maintaining the increased threshold voltage of the NFET.

3. The current reference circuit of claim 1 wherein the increased threshold voltage controls an amount of charge transferred to the switching capacitor during charging of the switching capacitor and wherein the amount of charge, in turn, controls a magnitude of said reference current flowing from the switching capacitor means.

4. A reference current generator comprising:

an FET having its gate doped with impurities of opposite polarity to that of its diffusions for increasing its threshold voltage by about a band gap of silicon;

a plurality of current mirrors including one of a first impurity type and one of a second impurity type, the current mirror of the second impurity type coupled to the FET for providing a current through the FET;

switching means including a switching capacitor, the switching means coupled to a frequency source;

the FET connected to the switching means for providing to the capacitor a voltage equal to about said increased threshold voltage for charging the capacitor; and the current mirror of a first impurity type connected to the switching means for discharging the capacitor at a frequency determined by the frequency source and for outputting a reference current generated by said discharging the capacitor.

5. A circuit comprising:

a second node;

a plurality of capacitors;

a plurality of switching means each including a capacitor and each coupled only to, and directly to, the first node, and to a frequency source for charging and discharging the capacitor at a rate controlled by a frequency of the frequency source; and selection means coupled to the plurality of switching means for selecting at least a first one of the plurality of switching means to charge and discharge a capacitor included in said at least a first one of the plurality of switching means, the selection means including means for selecting a different one of the plurality of switching means to charge and discharge a capacitor included in said different one of the plurality of switching means.

6. The circuit of claim 5 wherein the selection means further includes deactivation means for deactivating unselected ones of the plurality of switching means concurrently with selecting said at least a first one of the plurality of switching means, and concurrently with selecting said different one of the plurality of switching means.

7. A current reference circuit comprising:

a current mirror of a first impurity type;

a current mirror of a second impurity type;

a first transistor having its gate doped with impurities of opposite polarity than that of its other terminals such that the threshold voltage of the first transistor is increased, the first transistor coupled to the current mirror of the first impurity type for receiving a current therefrom and for generating a band gap voltage based on its increased threshold voltage;

a capacitor coupled to a switching means which, in turn, is coupled to the first transistor and to the current mirror of the second impurity type for alternately charging the capacitor to the band gap voltage and discharging the capacitor into the current mirror of the second impurity type, the switching means coupled to an input for receiving an input frequency; and the capacitor and the switching means providing an average current to the current mirror of the second impurity type based on a combination of the input frequency and the band gap voltage.

8. A current reference circuit comprising:

an NFET having its gate doped with impurities for raising a threshold of the NFET by about a band gap of silicon;

a PFET current mirror having a first one of its legs coupled to the NFET for providing a current flowing through the NFET;

an NFET current mirror coupled to a second leg of the PFET current mirror for controlling an amount of current flowing through the second leg of the PFET current mirror;

a resistor coupled to the NFET and to the NFET current mirror such that an amount of increase of the NFET's threshold voltage generated by the impurity doping is applied across the resistor for producing a reference current flowing from the resistor through the NFET current mirror.

9. The current reference circuit of claim 8 wherein a current flowing through said second leg of the PFET mirror controls a current flowing through said first leg of the PFET mirror, said current flowing through the first leg of the PFET mirror for providing said current flowing through the NFET and for maintaining the raised threshold voltage of the NFET.

10. A reference current generator comprising:

an FET having its gate doped with impurities of opposite polarity to that of its diffusions for increasing its threshold voltage by about a band gap of silicon;

a plurality of current mirrors including one of a first impurity type and one of a second impurity type, said current mirror of a first impurity type coupled to the FET for providing a current through the FET and for maintaining the band gap voltage; and a resistance means coupled to the FET for generating a reference current proportional to the band gap voltage.

11. The generator according to claim 10 wherein the current mirror of a second impurity type is connected to the resistance means and to the current mirror of the first impurity type for receiving the reference current and for controlling a current flowing through the current mirror of the first impurity type in response to the reference current.

12. A method comprising the steps of:

providing an FET having its gate doped with impurities of opposite polarity than its diffusion regions providing a current flowing through the FET;

isolating a difference in a threshold voltage of the FET produced by the doping with impurities of opposite polarity and the current flowing through the FET; and imposing only said difference in the threshold voltage of the FET across a known resistance to generate a reference current corresponding to said difference in the threshold voltage divided by a magnitude of the known resistance.

13. Apparatus comprising:

an input;

a first current mirror;

a second current mirror;

a first node;

a second node;

a first transistor coupled to the first node and to the first current mirror for establishing a first voltage at the first node, the first transistor having a gate doped with impurities of opposite polarity to that of its gate and source, said impurities of opposite polarity increasing the threshold voltage of the first transistor by an amount equal to about a band gap of silicon and increasing the first voltage established at the first node above a second voltage at the second node by the amount equal to about the band gap of silicon;

a second transistor coupled to the second node and to the second current mirror for controlling the second voltage at the second node; and a variable impedance connected to the input, the first node, and the second node for establishing an impedance between the first node and the second node proportional to a first variable reference frequency received at the input and for providing a variable current flowing into the second node that is proportional to the impedance established between the first node and the second node and to a voltage magnitude difference between the first node and the second node.

14. The apparatus of claim 13, further comprising:

a second input; and a second variable impedance connected to the second input, the first node, and the second node for establishing a second impedance between the first node and the second node proportional to a second variable reference frequency, which is a compliment of the first reference frequency, received at the second input and for providing a second variable current flowing into the second node that is proportional to the impedances established between the first node and the second node and to the voltage magnitude difference between the first node and the second node.

15. The apparatus of claim 14, wherein the first and second variable impedances each comprise a capacitor and a switching means, the switching means for controllably charging and discharging the capacitor in response to the first and second variable reference frequencies, respectively, and wherein the discharging of the capacitor provides the variable current flowing into the second node.

16. The apparatus of claim 13, wherein the second current mirror is coupled to the first current mirror for controlling an amount of current flowing through the first current mirror.

* * * * *